United States Patent [19]

Hanson et al.

[11] Patent Number: 4,644,727

[45] Date of Patent: Feb. 24, 1987

[54] STRAND CHAIR FOR SUPPORTING PRESTRESSING CABLE AND CROSS-MESH IN ELONGATED PRECAST CONCRETE PLANK

[75] Inventors: David W. Hanson, Golden Valley; Richard R. Koehn, Prior Lake; Richard C. Nash, New Prague; Lonnie G. Fox, Burnsville, all of Minn.

[73] Assignee: Fabcon, Inc., Savage, Minn.

[21] Appl. No.: 825,852

[22] Filed: Feb. 4, 1986

Related U.S. Application Data

[63] Continuation of Ser. No. 577,077, Feb. 6, 1984, abandoned.

[51] Int. Cl.[4] ..... E04C 5/16

[52] U.S. Cl. ..... 52/687; 52/689; 52/678

[58] Field of Search ..... 52/687, 688, 689, 682, 52/679, 678, 677

[56] References Cited

U.S. PATENT DOCUMENTS

| | | | |
|---|---|---|---|
| 1,903,356 | 4/1933 | Bitney | 52/689 |
| 3,114,221 | 12/1963 | Eriksson | 52/689 |
| 3,694,988 | 10/1972 | Skold | 52/678 |
| 3,694,989 | 10/1972 | Oliver | 52/678 |
| 3,783,574 | 1/1974 | Cennerelli | 52/687 |
| 3,830,032 | 8/1974 | Bobb | 52/687 |

FOREIGN PATENT DOCUMENTS

| | | | |
|---|---|---|---|
| 612486 | 1/1961 | Canada | 52/677 |
| 2228868 | 7/1974 | Fed. Rep. of Germany | 52/687 |
| 2434851 | 2/1976 | Fed. Rep. of Germany | 52/687 |
| 2540145 | 3/1977 | Fed. Rep. of Germany | 52/688 |
| 2930975 | 2/1981 | Fed. Rep. of Germany | 52/677 |
| 1573010 | 5/1969 | France | 52/684 |
| 2419372 | 10/1979 | France | 52/684 |
| 7804649 | 4/1978 | Netherlands | 52/684 |
| 532236 | 1/1941 | United Kingdom | 52/689 |
| 575653 | 2/1946 | United Kingdom | 52/677 |

OTHER PUBLICATIONS

International Price List, Jan. 1982, by Plasclip.

Plasclip Components for the Construction Industry, printed by RGM Lithoprinters, Yeovil, Somerset, England.

Preco Econochair Multi-Gage Mesh Reinforcing Chair, by Preco 55 Skyline Drive, Plainview, NY 11803 (Copyright 1975).

Brock-White Co. "Formwork" (single sheet).

Prestress Supply Inc. Lakeland Florida Form PL-181501.

Spillman Plastic Accessories, Brochure No 80-01.

*Primary Examiner*—Henry E. Raduazo

*Attorney, Agent, or Firm*—Vidas & Arrett

[57] ABSTRACT

The chairs include a lower chair portion for supporting multiple prestressing cables at the bottom of a plank and a narrow upper chair portion for supporting an upper prestressing cable located in the web between the hollow cores of the prestressed plank. The upper chair portion can be inserted into the strand receiving cups of the lower portion to form a structurally sound support for accurately placing the top and bottom reinforcing strands in the plank as it is cast.

8 Claims, 14 Drawing Figures

STRAND CHAIR FOR SUPPORTING PRESTRESSING CABLE AND CROSS-MESH IN ELONGATED PRECAST CONCRETE PLANK

This is a continuation of application Ser. No. 577,077, filed Feb. 6, 1984, and now abandoned.

BACKGROUND OF THE INVENTION

This invention relates to an improvement in a system for casting concrete panels and particularly to a single pass casting operation wherein slip forms are utilized to form core areas and deliver panel core material into these areas. The core material is dumped from the cores after at least partial curing of the panel.

A machine for forming such hollow core panels in a single casting operation is disclosed in U.S. Pat. No. 4,369,153. In that machine (and in earlier machines requiring two casting passes to form hollow core concrete planks such as are shown in U.S. Pat. No. 3,217,375 and U.S. Pat. No. 3,523,343), the concrete plank is formed on an extremely long casting bed which generally has a length in the 500′ to 680′ range. Prestressing cables are attached to stressing abutments at opposites ends of the bed. The cables are put under high tension prior to the commencement of casting. Despite the tensioning of the cables, they have a tendency to droop and/or move transversely from the desired position during casting of the concrete. Typically the casting machine has a strand guide suspended from it which guides the reinforcing strand as the concrete is being cast around it so that the strand is directed into approximately the correct position in the web between adjacent hollow cores.

Although plastic clips or chairs have been used to support rebar (reinforcing, unstressed steel) in various concrete applications, those clips generally have only a single cable supporting cup and are ordinarily suitable for supporting rebar between ½″ and ¾″ above the surface of the casting pallet. Such prior art clips and chairs are not suitable for supporting top strand as a hollow core concrete slab is cast on a single pass casting machine such as the one in U.S. Pat. No. 4,369,153.

SUMMARY OF THE INVENTION

The present invention provides a strand chair assembly having a lower separable portion capable of supporting a plurality of bottom reinforcing strand in a single pass casting machine for the manufacture of hollowcore reinforced concrete panels or planks. Top reinforcing cable is supported by a cup in a top strand chair portion which has a base portion designed to be insertable in two of the strand cups of the lower chair portion.

DETAILED DESCRIPTION

Figure 1:
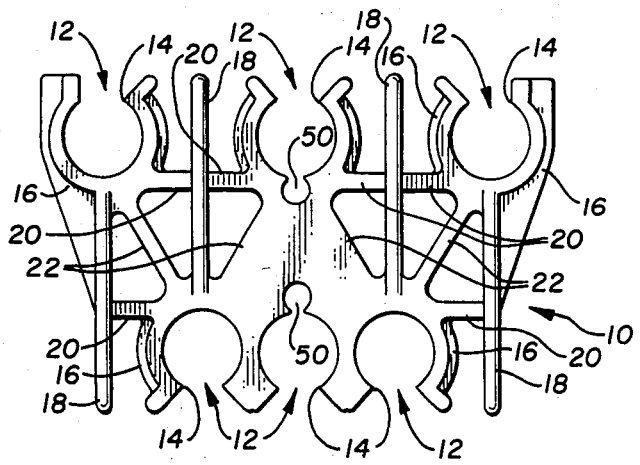
FIG. 1 is a front elevational view of the lower portion of the strand or mesh chair.
Figure 2:
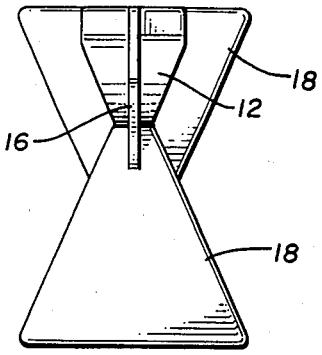
FIG. 2 is a side view of the chair shown in FIG. 1.

Referring now to FIGS. 1 and 2, the lower portion of a preferred embodiment of the strand chair assembly is shown. The lower portion 10 is comprised of a plurality of individual strand receiving cups generally designated 12 each of which has a strand receiving slot 14 which is adapted to receive the cable section inserted therein. As can be seen in FIG. 1, there are three cups which open upwardly and three cups which open downwardly. The lower chair portion can be oriented with either set of cups on the top to accommodate various strand placement patterns as will be discussed in more detail in connection with the description of FIGS. 9 through 12.

Figure 3:
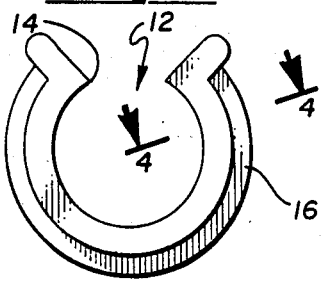
FIG. 3 is an enlarged detail showing a single strand cup from the chair of FIG. 1.
Figure 4:
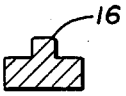
FIG. 4 is an enlarged section view of the strand cup of FIG. 3 along lines 4—4.

FIG. 3 shows an enlarged view of a typical strand cup 12. As can be seen in FIG. 4, the innerface of the strand cup 12 has a rib 16 projecting therefrom. FIG. 2 shows the side view of the strand chair structure which, it can be appreciated, is relatively resistant to tipping along its axis by the widened base portion 18 which is of a generally triangular shape shown attached to each of the outermost strand cups diametrically opposite to the slot 14. The majority of the cups are directly supported by base members 18 which directly bears the weight or other downwardly force of the cable inserted into them. In addition to the support members 18, there are lateral supports 20 between strand cups in a plane perpendicular to the axis of the cable. The supports 18 attached to strand cups extend parallel to the axis of the cable. In addition to lateral supports 20 there are also diagonal supports 22 connected between strand cups in the upper and lower planes. Preferably, each cup 12 is constructed and arranged such that each acts as a base support by extending to the plane described by support members 18.

Figure 5:
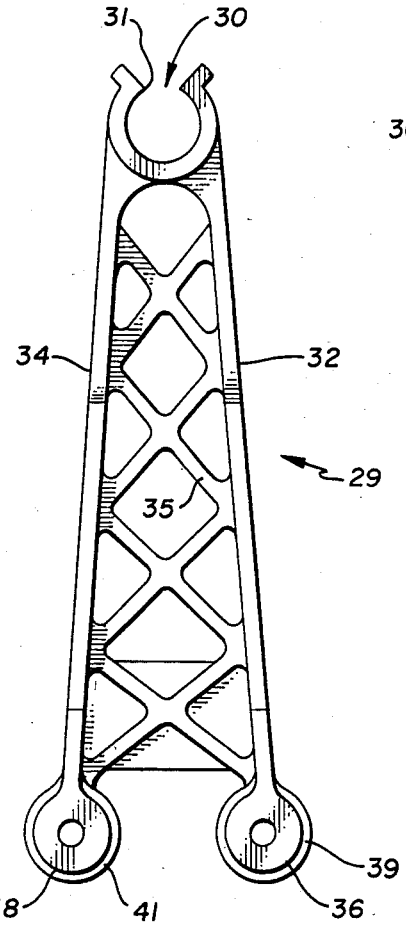
FIG. 5 is a front view of the top strand chair.
Figure 6:
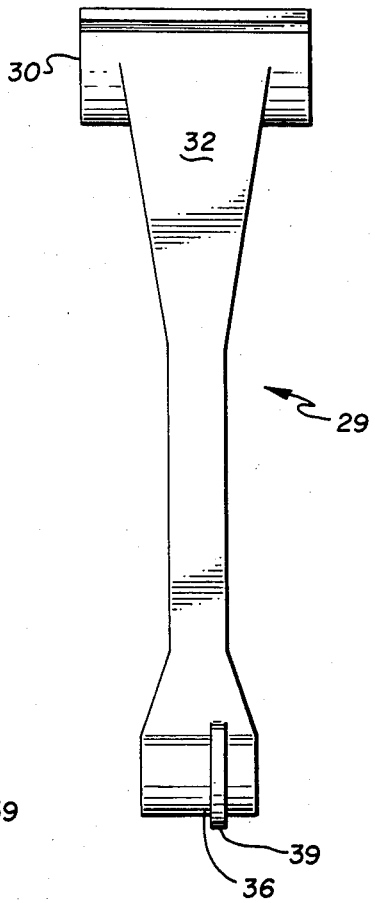
FIG. 6 is a side view of the chair of FIG. 5.

The resulting structure for the lower strand chair is therefore strong and permits use of the strand chair to support up to three lower strands inserted in either the widely spaced or closely spaced slots depending upon the orientation of the lower member 10. The structure is also sufficiently strong and stable against tipping to support the upper strand chair shown in FIGS. 5 and 6 as discussed more fully below.

The vibrations of the casting machine are transmitted to the casting bed and into the strand chairs of the invention. The vibrations consolidate the concrete around the strand and the strand chair.

Projecting ribs 16 may be increased in thickness and width to provide greater support for heavy strand. Preferably, the strand chairs of the invention are molded from themoplastic polymers such as polypropylene.

The upper strand chair portion includes a strand receiving cup 30 which has a strand receiving slot 31 and is supported by a pair of side members 32 and 34. A lattice or matrix reinforcing structure 35 is connected between the side members 32 and 34 to add strength but little volume or weight to the overall structure. At the base side members 32 and 34 are connected to generally cylindrical interconnecting portions 36 and 38 respectively which have a diameter approximately equal to or slightly less than the inside diameter of the strand cups in the lower portion 10 of the strand chair assembly. The size of the strand receiving slot 14, the resilience of the lower chair and the size of the interfitting cylindrical portions 36 and 38 of the upper strand chair cooperate to allow the upper chair to be interlocked into the lower chair to form a unitary assembly for supporting top strand or a combination of top and bottom strands. Preferably interconnecting portions 36 an 38 include stops 39 and 41 which limits the travel of portions 36, 38 in slots 14 of lower portion 10. During casting, the addition of concrete to the moving bed tends to disrupt the interlocking arrangement of the chairs. Stops 39 and 41 prevent the upper chair from slidingly disengaging from the lower chair strand slots.

Figure 6A:
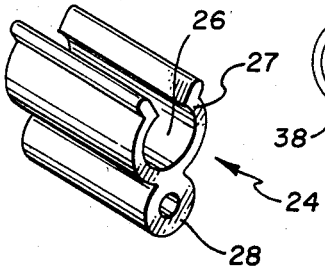
FIG. 6*a* is a perspective view of a top strand chair extension.

An upper strand chair extension 24 shown in FIG. 6*a* consists of a strand receiving cup 26 which has a strand receiving slot 27 attached to a cylindrical interconnecting portion 28. The size of strand receiving slot 31, the resilience of the upper strand chair 29 and the size of the interfitting cylindrical portion 28 of the extension cooperate to allow the extension to be interlocked into the upper strand chair 29.

The upper strand chair extension 24 adds height to the combination of the lower chair 10 and upper chair 29 such that a top strand 54 positioned in strand receiving slot 27 is closer to the finished upper surface of plank 56. The top strand 54 is preferably as close to the upper plank surface as possible. However, for cosmetic purposes, and for strength extension 214 is not normally used in 8" thick planks. Steel rebar 55 laid perpendicular to strand 54 from being visible on the finished surface. However, if the panel will be used as an insulated sandwich panel composed of a concrete layer 56, insulating layer 57 and top concete layer 59 no cosmetic defect will appear with strand placed near the plank surface which contacts insulating layer 57.

Figure 7:
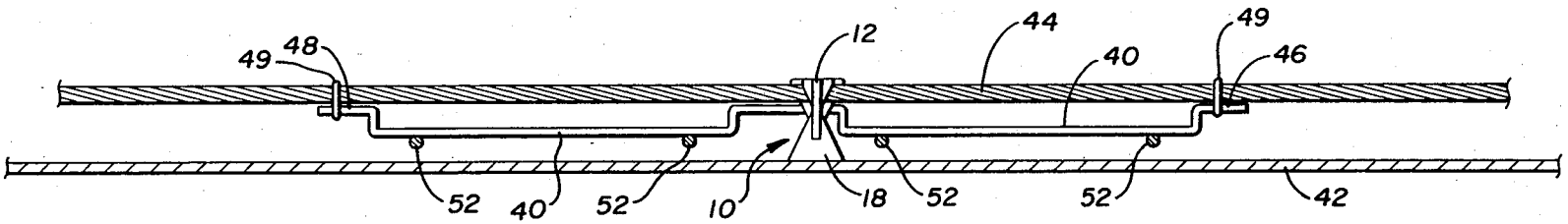
FIG. 7 is an elevational view of the strand chair positioned on a stress frame bed showing use of the lower portion only.

FIG. 7 shows a side view of a lower strand chair portion 10 supporting the reinforcing bottom strand 44 above a casting pallet 42. A reinforcing base mesh 40 is shown as having been wire-tied 49 to the strand at the ends 46 and 48. By appropriate positioning of the lower chair 10 in accordance with the invention it is not necessary to tie the mesh 40 to the prestressing cable 44. The mesh will be held in locked relationship as will be described. The relatively light-weight reinforcing bar mesh 40 is inserted into a slot 50 in the central strand cups 12 of the lower chair position 10 as shown for example in FIGS. 1 and 9–12. Thus, the rebar mesh 40 is separately supported in an appropriately sized slot 50 in the lower strand chair 10 and the reinforcing strand 44 is inserted through slot 14 into the strand cup 12 to secure the rebar mesh 40 in place in the proper alignment with the reinforcing strand. Transverse reinforcing rods 52 forming a part of mesh 40 are suspended from the lower portion of rebar mesh 40 a shown in FIG. 7.

It is desirable to provide a reinforcing mesh near the bottom of the concrete plank 56. A preformed mesh 40 is formed by welding or otherwise attaching transverse reinforcing rods 52 to form a grid or mesh of reinforcement. The grid to be truly effective must be supported slightly above the casting pallet surface 42.

The invention provides accurate placement of preformed mesh 40 at the correct height and lessens time-consuming wire-tying of the mesh to bottom strand 44. The reinforcing bars of mesh 40 are supported in slot 50 in the central strand cups 12 of the lower chair portion 10. Preferably, when the finished plank is to be cut to desired lengths the saw cuts in th cured plank 56 are made between transverse rods 52 of the invention.

When a predetermined mesh width is utilized, placement of the strand chairs positively aligns the strand both vertically and laterally to the casting bed and to the mesh. The strand chairs of the invention eliminate the need for conventional strand guides. Forces in the product are more uniform due to the strand chairs which greatly lessens strand sagging in the uncured concrete.

The position alignment provided by the strand chairs also prevents twisting of the strand. The strand, mesh and other reinforcing rods may therefore be more accurately positioned within the concrete panels. Attachment plates and end lifters may be accurately positioned in the concrete panels due to the accurate placement of the fabricated mesh supported by the strand chairs.

Figure 8:
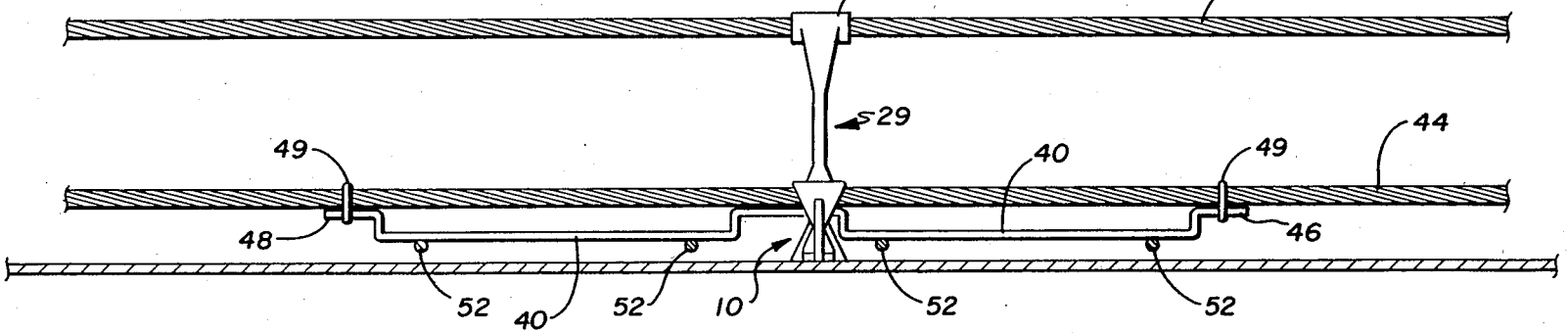
FIG. 8 is an elevational view of the lower strand chair and top strand chair assembled and supporting both the top and bottom strand and a reinforcing mesh above a casting pallet.

FIGS. 9 through 12 show transverse reinforcing rods 52 in phantom, enlarged and higher above the casting pallet 42 than preferred for drawing clarity. FIGS. 7 and 8 clearly illustrate the relative diameter of transverse rods 52 and their close proximity to the casting pallet 42.

FIG. 8 shows basically the same arrangement as FIG. 7 for the lower strand 44, reinforcing bar mesh 40 and transverse reinforcing bars 52 but shows additionally the use of an upper chair 29 which supports the top strand 54 in strand cup 30. The upper chair is positioned into place in two of the strand cups of the lower strand support 10.

Figure 9:
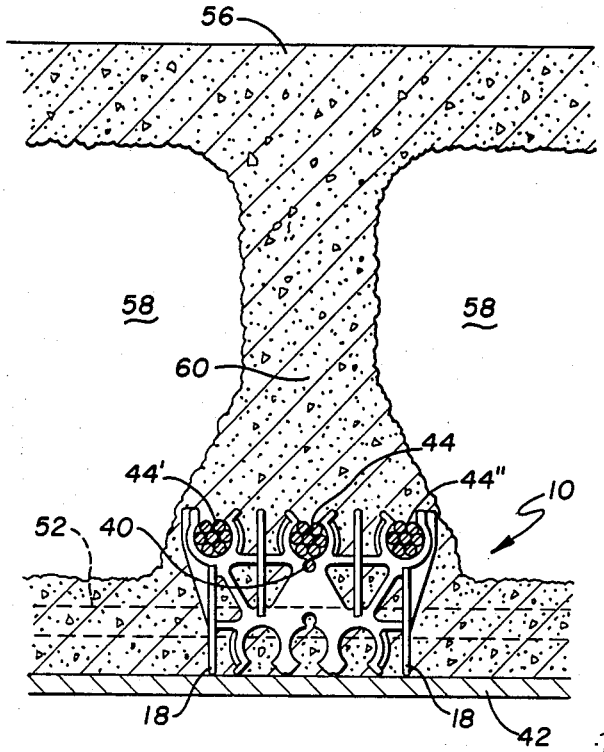
FIGS. 9 through 12 are sectional views of concrete panels showing various cable and strand chair arrangements utilizing the upper and lower chair portions of the strand chair.

FIG. 9 shows a cross section of a piece of plank 56 having a pair of voids 58 and a web 60 in which lower strand groups 44 and 44' and 44" are shown inserted in the three top widely spaced strand cups of the lower strand chair portion 10. The strand chair is supported on the casting pallet 42 on support members 18 and strand cups as shown.

Figure 10:
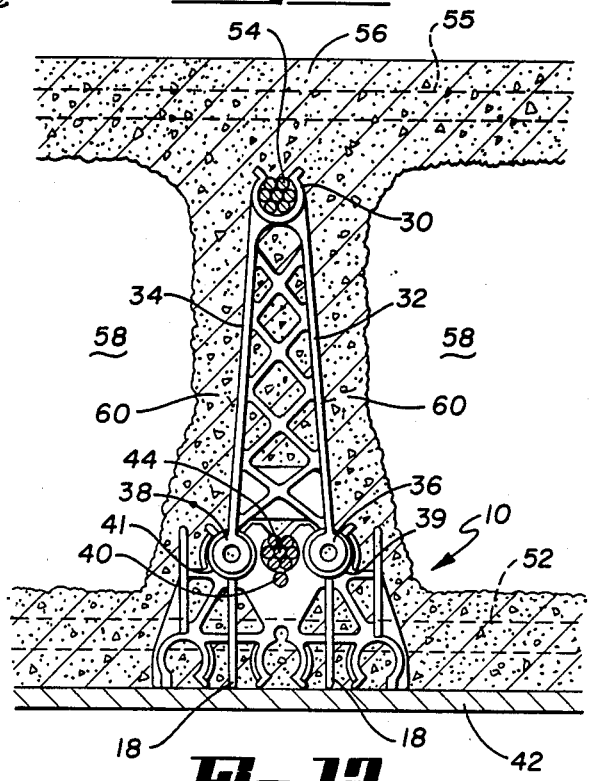

FIG. 10 shows a different configuration of prestressing cables in a panel. In FIG. 10, the lower strand chair portion has been inverted so that the two closely spaced cups 12 are on top. The cylindrical footing portions of 36 and 38 of the upper strand chair are snapped or otherwise positioned into their corresponding strand receiving cups 12 as shown. The upper cable or strand 54 is shown inserted in the upper receiving cup 30 while the lower strand 44 is shown inserted int the central strand cup.

Figure 11:
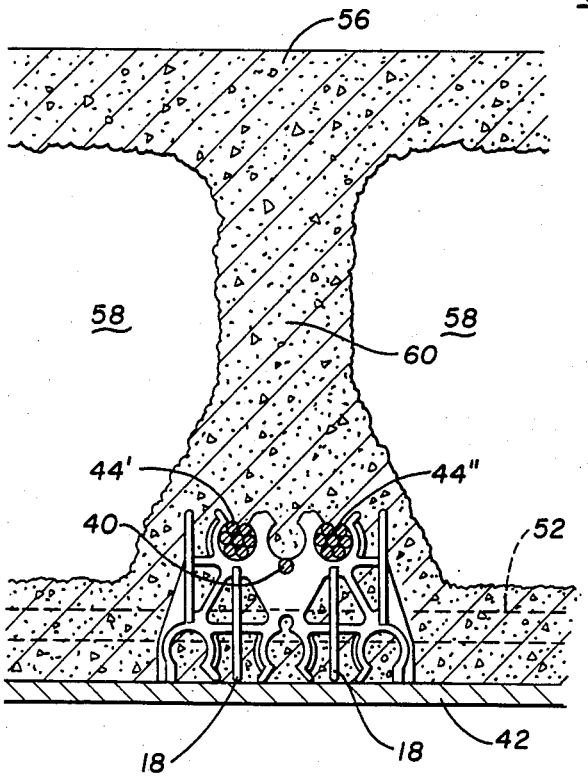
Figure 12:
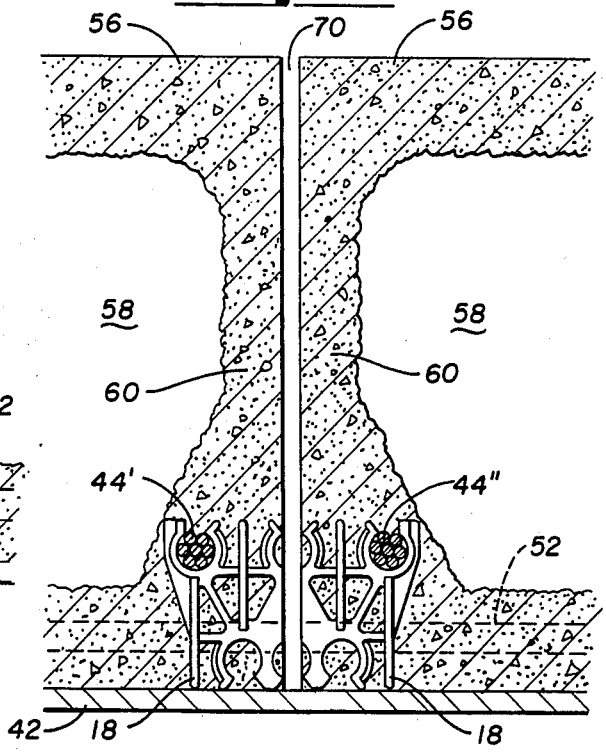
Figure 13:
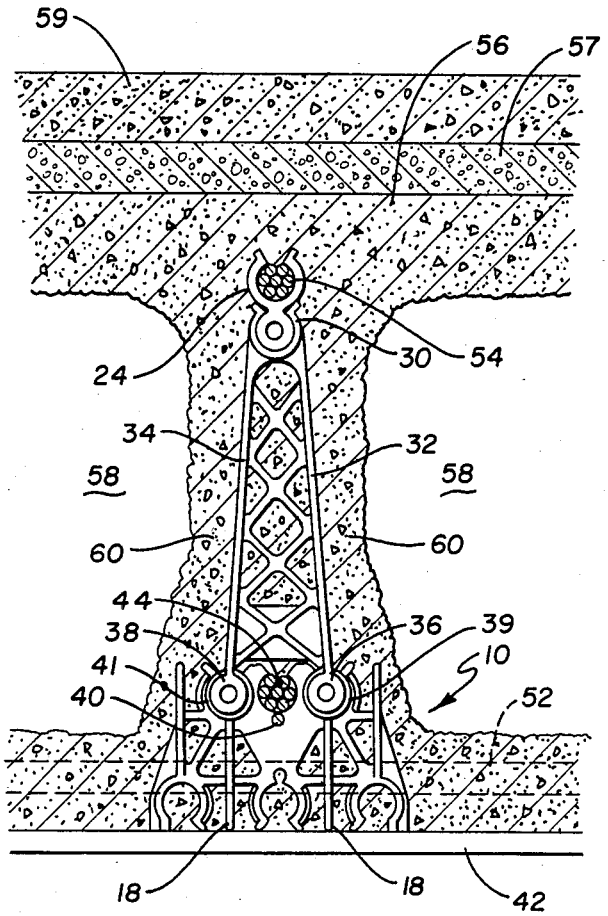
FIG. 13 is a sectional view of an insulated concrete sandwich panel with upper and lower strand portions and extension in place.

FIG. 11 shows yet another configuration of cables which can be served by the strand chair. Two bottom strands 44' and 44" are shown inserted in the outside strand cups 12. Finally, FIG. 12 shows yet another arrangement of strand. The strands 44' and 44" are in FIG. 12 positioned in the two outermost strand cups 12 of the widely spaced plane of strand cups in lower portion 10. In this embodiment, the plank has been longitudinally sawed into two plank sections as shown and the portion of the lower strand chair 10 shown in phantom outline in kerf 70 has been removed during the sawing process. The present invention provides accurate placement of the strand, which greatly facilitates the sawing of the plank as shown in FIG. 12 and in other strand placement configurations which precise positioning of the strand is important.

The stable structure and accurate placement provided by the invention permits the use of the two strand chair portions as shown in FIG. 10 to support top strand 54, mesh 40 and bottom strand 44 while the plank or panel is being cast in a single pass casting machine. The strand chairs as described present a minimum bearing surface to the casting bed, thereby decreasing the surface area of supports showing on the cured concrete product. Preferably, the strand chairs are molded of plastic colored to match the concrete. The lattice or matrix reinforcing structure 35 allows the free flow of low slump concrete around and through the strand chairs maintaining the concrete's structural strength.

What is claimed is:

1. An assembly for supporting reinforcing or prestressing strand comprising:

a lower strand chair of molded plastic including a plurality of strand receiving cups each of which is constructed for receiving a strand therein, each of said strand receiving cups defining a strand receiving slot adapted to receive a strand section therein, said strand receiving cups connected to and supported by a common frame means having a top and bottom, said frame means including spaced base members, the base members constructed to extend transversely of said frame means thereby providing resistance to tipping of said chair said lower strand chair being constructed and arranged such that said frame includes base members at said top and bottom such that either said top or bottom of said lower strand chair may be the base; and an upper strand chair of molded plastic having a strand cup mounted at one end of a frame and at least one engagement means for connecting said upper strand chair to the lower strand chair by inserting the engagement means into strand receiving cups of said lower strand chair, the engagement means comprising portions adapted and arranged to snap fit into some of said cups of said lower strand chair.

2. The assembly of claim 1 wherein said lower strand chair frame means includes a reinforcing lattice to provide strength and low weight.

3. The assembly of claim 1 wherein said lower strand chair strand receiving cups include strengthening ribs.

4. The assembly of claim 1 wherein said lower strand chair base members are constructed and arranged to provide stability with a lower surface area.

5. The assembly of claim 1 wherein said upper chair frame includes a reinforcing lattice.

6. The assembly of claim 1 wherein said upper chair engagment means comprises generally cylindrical interconnecting portions adapted and arranged to snap fit into said lower strand chair.

7. A subassembly for supporting reinforcing or prestressing strand including:

a lower strand chair comprising a plurality of strand receiving cups each of which is constructed for receiving a strand therein, each of said strand receiving cups defining a strand receiving slot adapted to receive a strand section therein; said strand receiving cups connected to and supported by a common frame means, said frame means including spaced base members, the base members constructed to extend transversely of said frame means thereby providing resistance to tipping of said chair;

an upper chair having a strand cup mounted at one end of a frame and at least one engagement means for connecting said upper strand chair to the lower strand chair by inserting the engagement means into strand receiving cups of said lower strand chair, and an upper chair extension having a strand cup mounted at one end of a frame and engagement means for connecting said extension to the upper strand chair by inserting the engagement means into the strand receiving cup of said upper chair.

8. The upper chair extension of claim 7 wherein said upper chair extension engagement means comprises a generally cylindrical interconnecting portion adapted and arranged to snap fit into said upper strand chair cup.

* * * * *